United States Patent [19]

Watkiss et al.

[11] Patent Number: 4,537,391

[45] Date of Patent: Aug. 27, 1985

[54] ROTARY COLLATING AND/OR INSERTING MACHINES AND METHOD OF COLLATING AND/OR INSERTING SHEET MATERIAL

[75] Inventors: Christopher R. Watkiss; Michael C. Watkiss, both of Biggleswade, England

[73] Assignee: Watkiss Automation Limited, Bedfordshire, England

[21] Appl. No.: 452,182

[22] Filed: Dec. 22, 1982

[30] Foreign Application Priority Data

Dec. 24, 1981 [GB] United Kingdom ..... 8138992

[51] Int. Cl.[3] ..... B65H 3/08

[52] U.S. Cl. ..... 271/101; 270/58

[58] Field of Search ..... 271/101, 100, 99, 102, 271/108; 270/58

[56] References Cited

U.S. PATENT DOCUMENTS 4,383,683 5/1983 Rathert ..... 271/101

FOREIGN PATENT DOCUMENTS 57-72532 5/1982 Japan .

2066787A 7/1981 United Kingdom .

*Primary Examiner*—George E. A. Halvosa

*Assistant Examiner*—John A. Carroll

*Attorney, Agent, or Firm*—Seidel, Gonda & Goldhammer

[57] ABSTRACT

In a rotary collating and/or inserting machine where individual sheets are peeled from the bottom of a plurality of stacks of sheets arranged spaced around a circle on a table and are moved down through one or more radial slots in the table, the separation of the bottom sheet of each stack, preferably at a corner, is initiated by creating changes in air pressure in a cyclically controlled manner at or adjacent to the upper region of at least one slot. This can be accomplished by the provision of suction holes along the length of at least one slot or by changing the contour of the table surface, such as by incorporating a bellows. To aid onward movement of a sheet into a slot after initial separation from the stack, the initial suction effect which either acts directly on the sheet or changes the contour of the table surface is shut off or reversed as the bottom sheet passes down through the slot. Cyclically controlled suction devices are preferably provided at or adjacent to the lower region of each slot.

22 Claims, 21 Drawing Figures

FIG.4a.
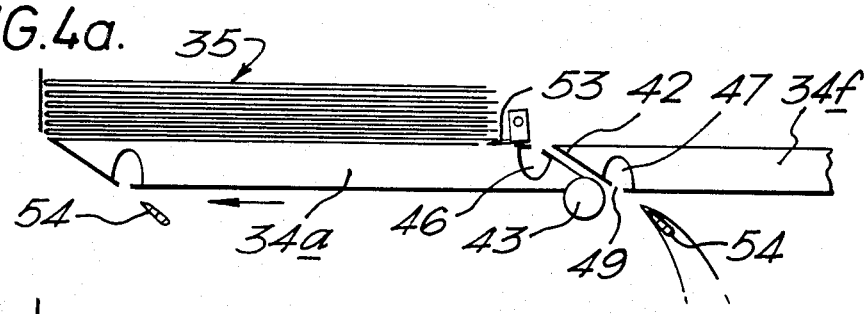
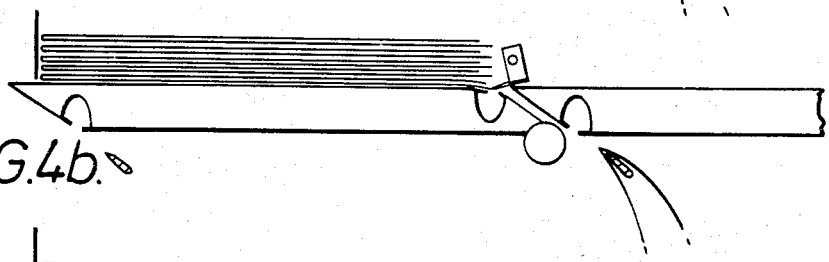
FIG.4b.
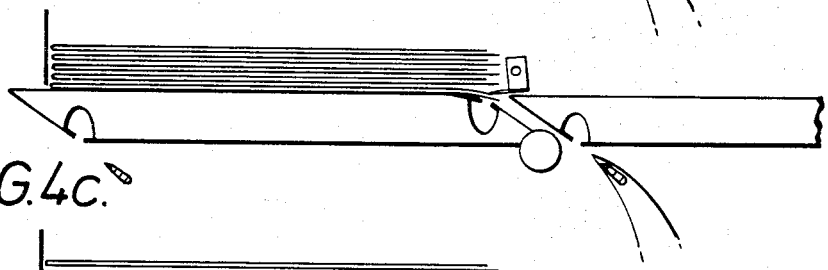
FIG.4c.
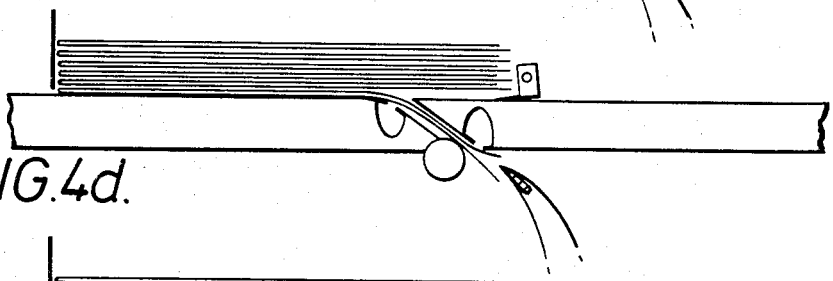
FIG.4d.
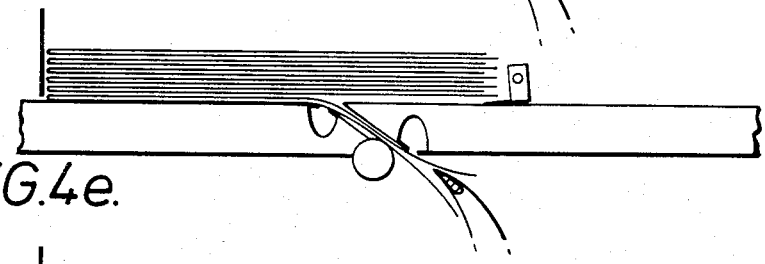
FIG.4e.
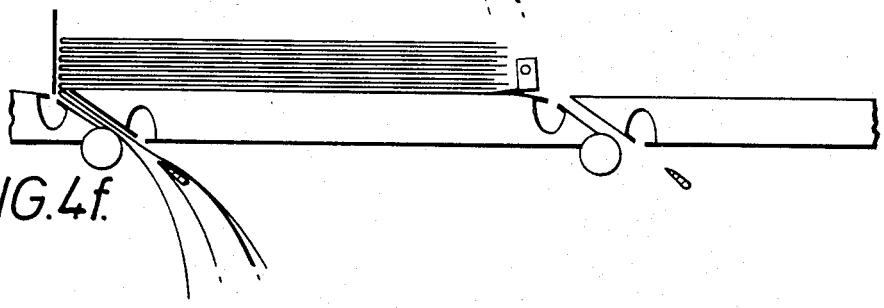
FIG.4f.

ROTARY COLLATING AND/OR INSERTING MACHINES AND METHOD OF COLLATING AND/OR INSERTING SHEET MATERIAL

FIELD OF THE INVENTION

This invention relates to rotary collating and/or inserting machines, and is also concerned with methods of collating and/or inserting sheet material, both single sheets and signatures and also folded sections.

Many different types of collating machine are known. The majority of such known machines, whether operating on mechanical, pneumatic or hydraulic principles, take individual sheets from the top of a plurality of stacks of sheets, usually by a lifting or sliding movement. Many of these conventional machines have considerable drawbacks. It is common for example for such collating machines to be extremely bulky and to occupy a large floor area. One problem which arises with many of the conventional collating machines is that they are unable to handle large-size sheets, and this imposes severe limitations on their ability to handle a large range of paper sizes. Furthermore, the conventional technique of gripping a sheet along the length of one edge requires relatively complex gripping mechanisms.

A number of known collating machines use suction in order to peel sheets away from a stack. However, many of these machines involve a complex structure, and the suction is often applied from the top to remove the top sheet of the stack.

Our own published British patent application Ser. No. 2066787A discloses a rotary collating machine in which individual sheets are peeled away from the bottom of respective stacks of sheets which are arranged spaced around a table. In this machine the peeling action is effected by the use of a plurality of perforated suction rollers equal in number to the stacks and equally spaced around the circumference of the machine. The interior of each suction roller is connected to a source of suction, and each suction roller is arranged to pass beneath the stacks and to draw down the corner of a sheet as it reaches a stack.

The use of perforated conical suction rollers has proved to be workable, but still has certain drawbacks and disadvantages. In particular, they do not necessarily cope well with all grades of sheet material.

SUMMARY OF THE INVENTION

It is an object of the present invention to provide a rotary machine which peels individual sheets from the bottom of stacks of sheets arranged around a table, and yet which avoids the need to use perforated suction rollers.

It is a further object of the present invention to provide a rotary machine which is even simpler than that described in our published British patent application No. 2066787A.

An important feature of the present invention lies in the use of a table provided with at least one substantially radial slot therethrough and in the use of different air pressures as the primary means to separate, guide and move the sheets. The machine of the present invention has a minimum number of moving parts and the differential air pressure is used to maximum effect to provide the necessary guiding functions. This results in a very fast-acting and efficient peeling action as the relative rotation between table and stacks takes place.

In accordance with the present invention there is provided a method of collating and/or inserting into one another individual sheets from a plurality of stacks of sheets of material arranged spaced around the center of a circle on a table, in which the table is provided with at least one substantially radial slot down through which the sheets are arranged to pass as they are separated from the bottom of the respective stacks, in which the separation of the bottom sheets is initiated at least partially by creating changes in air pressure in a cyclically controlled manner within the contour of the table at or adjacent to the upper region of at least one slot, and in which to aid onward movement the forces acting on the bottom sheet at its entry into a slot in a sense to divert the sheet into the slot are changed by varying the air pressure as the bottom sheet passes down through the slot.

Also in accordance with the present invention there is provided a rotary machine comprising a table which is adapted to receive a plurality of stacks of sheets of material spaced at intervals around a circle centered on the axis of rotation of the machine, in which the table is provided with at least one substantially radial slot down through which sheets separated from the bottom of the respective stacks are arranged to pass, in which suction means are provided within the contour of the table to create changes in air pressure at or adjacent to the upper region of at least one slot, and in which control means are provided for the suction means and are operative to cause cyclic variations in the effect generated by the suction means on the sheets during the period from initial separation of a bottom sheet from a stack to movement of the sheet down through a slot.

In the machine of the present invention there is preferably provided means to create both positive and negative air pressures at the table surface. The initiation of the separating action from beneath the stacks of sheets is effected preferably by creating suction to cause a corner of each sheet to be diverted downwards, whereas the greater part of the table surface is provided with holes through which a positive air pressure can be generated to provide an upward thrust on the bottom of each stack.

The table is preferably formed in sectors with slots extending radially between the individual sectors. Each table sector is generally hollow for the passage of air, and with a vacuum duct arranged within the table contour to communicate with appropriate suction holes or with a collapsible bellows mechanism.

An important feature of the present invention lies in the use and provision of a circular fluid table divided into sections by angled slots across the greater part of the radius. By providing holes in the surface of the table, and valving them, one achieves a very simple and effective system of control for the stacks. As the air pressure builds up within the table the venturi effect of the escaping air between the seating in the underside of the top surface of the table and the balls which are retained in close proximity to the seating lifts the balls, thereby closing the valves and allowing air pressure to build further, until sufficient weight is applied to the slightly protruding balls to release the air pressure under the stack. By this means, as soon as the stack becomes too light to overcome the air pressure, the valves will close, thereby ensuring that when a few sheets are left, it will still remain in control.

In one preferred embodiment the trailing edge of at least one radial slot has, at any given time, one effective port which is connected to a valve, allowing suction to be applied to that port at the instant that the corner of the stack passes above it, thereby pulling down the bottom sheet through the slot, initiating a peeling action at the bottom of the stack. Rotating with the table, and directly below each segment, is a catch tray; therefore, as a sheet is peeled from the bottom of the stack, the tray moves in underneath it, lowering the sheet on to the sheet from the preceding stack. When the circuit is complete, the completed sets can be brushed from the tray by a stationary brush which arrests the set of sheets with the tray rotating away from underneath it.

The radial slot or slots in the table are preferably angled slots inclined at approximately 55° to the vertical. Thus, each table sector has a relatively sharp top leading edge, and a smoothly downwardly sloping upper trailing edge. It is within this upper trailing edge that suction holes can be provided for the alignment of one hole with the corner of a sheet so that the corner of the sheet can be sucked down and into the slot as the table and stack rotate relatively. Preferably at the underside of each table sector, adjacent to the leading edge, i.e. adjacent to the bottom of the radial table slot, there is provided further duct means communicating with a hole in the table surface so that a guidance function can be exerted by suction on the sheet as it reaches the bottom of the radial table slot.

Alternatively, the upper trailing edge may incorporate a collapsible bellows structure which is controlled to cause the corners of the sheets to be diverted downwards in a positive manner.

A preferred feature of the invention is the provision of a separator blade associated with each stack of sheets and positioned at the corner of the stack from which the peeling action is initiated. The separator blade is preferably a pivotable blade which underlies the leading corner of the stack and which, as the radial table slots pass beneath it, tilts downwards to allow one sheet to be diverted away, and thereafter is tilted up by the oncoming table to restrain the remaining sheets from passing down into the slot.

Therefore, the machine of the present invention comprises a single table, which feeds from the bottom of the stack, and provides for simple continuous top loading. The stacks can be any depth and there can be as many stacks on the circumference of the table as the paper size will allow, for example 7 A3s or up to 16 A5s. The machine is therefore a continuous feeding deep pile self-adjusting paper hopper system.

A suction feed system peeling from the bottom of the stacks ensures gentle, fast and reliable feed for a very wide range of materials from tissue paper to art paper folded sections, and the conveyor system which is an integral part of the table in the form of trays beneath each segment, and a completed-set dispensing system which brushes the sets from the rotating trays by a static brush, ensures that even large flimsy sheets remain under control on delivery.

The machine of the present invention has a single moving part, i.e. the table itself, providing the separation, the conveying, and the stacking, with continuous feeding, infinitely variable pile heights, capable of handling fine soft paper to heavy folded sections for collating and collating-inserting.

Although reference has been made above to sheets of paper, card or like material it is to be understood that the machine of the present invention is capable of separating away and feeding not only single sheets and signatures, but also folded sections. The term "sheet" used herein is to be understood as including all such items. This makes the machine extremely versatile. The machine is extremely simple in construction, has a minimum of moving parts and provides an extremely rapid and very reliable sheet feed cycle.

The rotary collating machine of the present invention is able to handle extremely large sheets of paper, is able to handle both flimsy sheets and sheets of card with equal ease, and utilizes extremely simple pneumatic circuitry to create the necessary differential air pressures.

BRIEF DESCRIPTION OF THE DRAWINGS

In order that the invention may be better understood, a number of embodiments of rotary machine in accordance with the invention will now be described by way of example and with reference to the accompanying drawings, in which:

FIGS. 4*a* to 4*f* constitute a schematic sequence diagram illustrating how the bottom folded section of a stack is peeled away from the bottom of a stack in a machine in accordance with the present invention, the sequence showing the separation and feeding of a folded section and the insertion of one inside another;

DESCRIPTION OF THE PREFERRED EMBODIMENT

Figure 3:
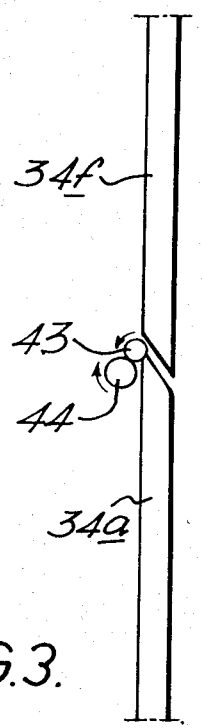
FIG. 3 is a section taken along the line III—III of FIG. 1.

In the illustrated embodiment, only those features of the rotary collating/inserting machine are shown which are essential to an understanding of the principles underlying the present invention. Much of the frame structure has been omitted from the drawings for the sake of clarity. Additionally, only one of the plurality of stations around the rotary machine is shown in detail in the drawings, it being understood that each of the plurality of stations around the circumference of the machine will be identical. Furthermore, general references herein to a "sheet" or "sheets" are to be understood as also including folded sections, such as shown in FIGS. 4*a* to 4*f*.

As shown in the drawings, the rotary collating/inserting machine comprises a rigid central column 10 mounted on a base 11 and comprising framework 12. An air pump 13 is mounted within the column. A pressure conduit 14 and a suction conduit 15 extend upwardly from the pump 13. The pressure conduit 14 communicates with an annular chamber 16, and thence with an upwardly extending pipe 17. The pipe 17 is provided with a first set of ports 18 for the delivery of air under pressure, and above those ports 18, with a second set of ports 19 for the intake of air. Between the delivery ports 18 and the intake ports 19 the air pipe 17 is provided with a seal 20 which encircles the upward extension of the suction pipe 15.

The top of the annular air chamber 16 is defined by a horizontal support plate 21. On this support plate 21 around the air pipe 17 is positioned an annular thrust bearing 22. A hollow cylindrical shaft 23 is seated on the bearing 22 and extends upwards coaxially about the pipe 17. The shaft 23 is rotatably driven from a motor 24 by way of a pulley wheel system 25. The top of the shaft 23 is formed as a rigid annular support plate 26. Spaced above the lower support plate 26 is a similar annular upper support plate 27. The upper support plate 27 carries a housing 28 which defines a suction chamber 29. The top of the air pipe 17 is closed by a rigid horizontal top plate 30.

Figure 1:
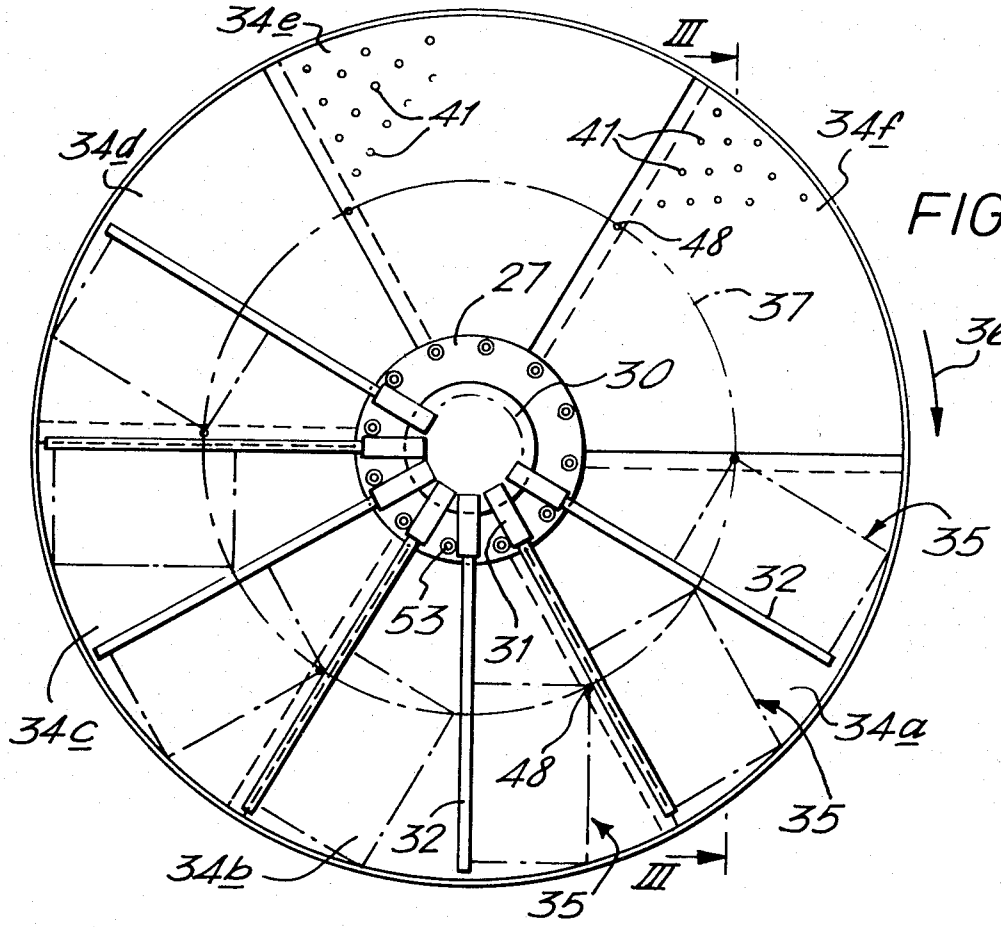
FIG. 1 is a top plan view of the rotary collating/inserting machine.
Figure 2:
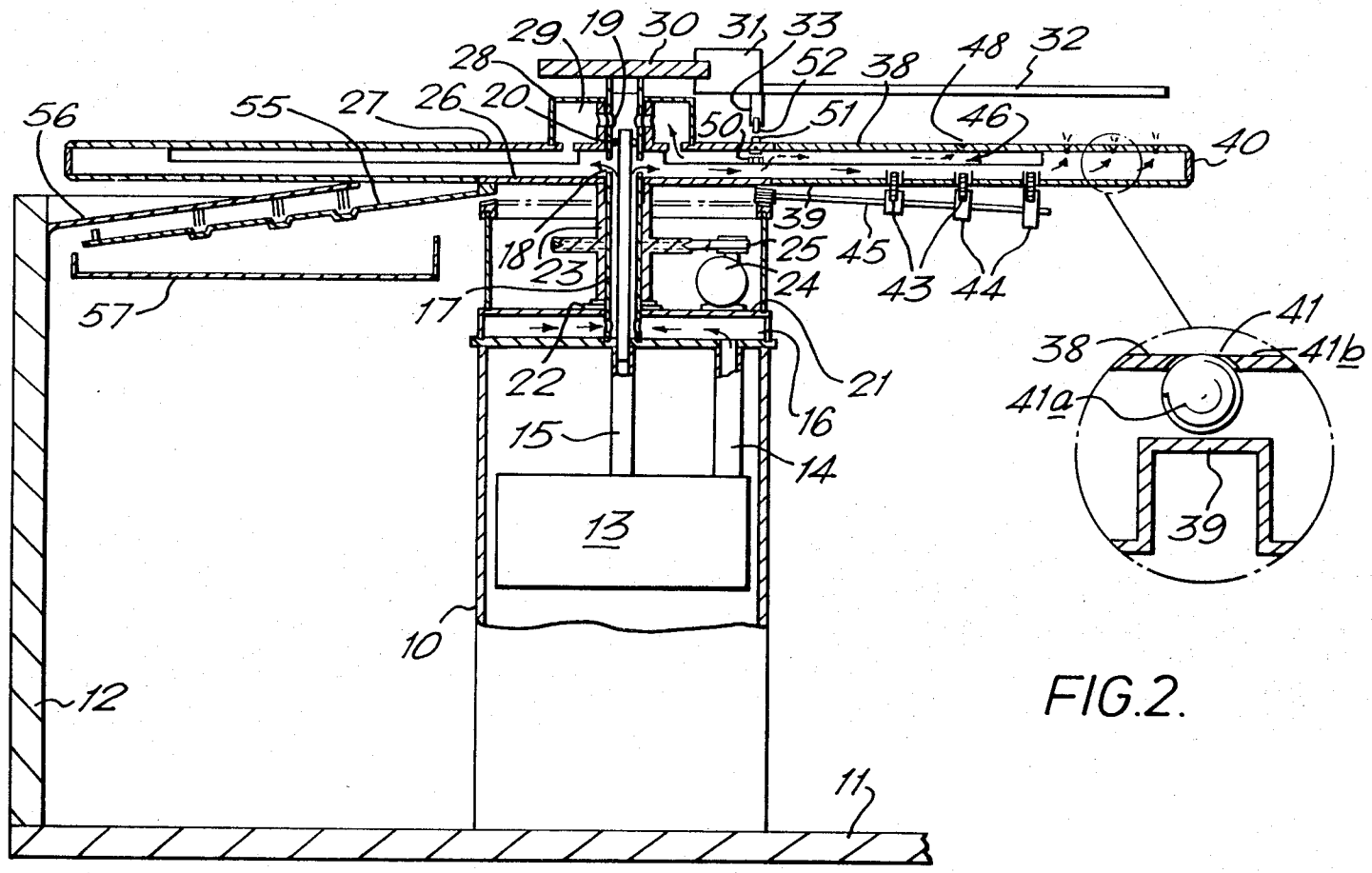
FIG. 2 is a schematic side elevation, partly in section, of the machine of FIG. 1, the sectional view being generally a transverse section through the center of the machine, but with some components added and other components omitted for clarity.
Figure 5A:
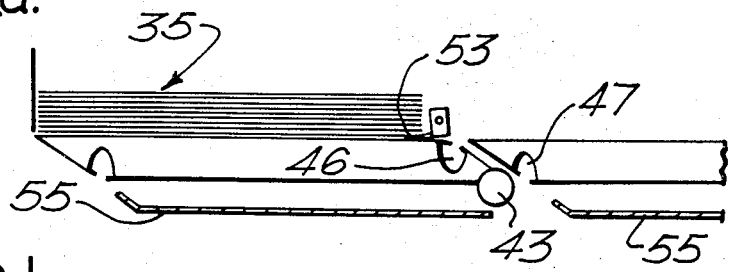
FIGS. 5*a* to 5*f* constitute a similar schematic sequence diagram showing the separation and feed sequence for single sheets and signatures; and, FIGS. 6*a* to 6*f* constitute a further schematic sequence diagram showing the separation and feed sequence for single sheets and signatures on a rotary machine with a modified table structure.
Figure 5B:
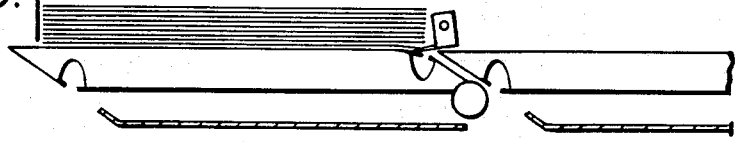
Figure 5C:
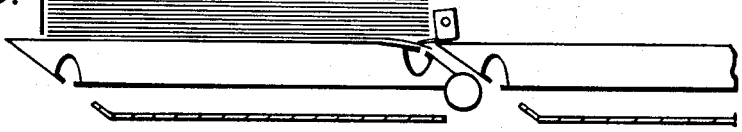
Figure 5D:
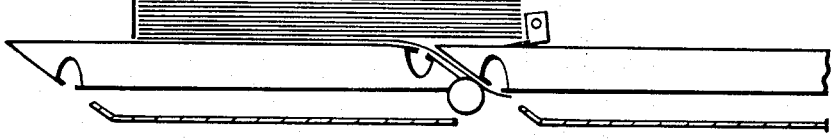
Figure 5E:
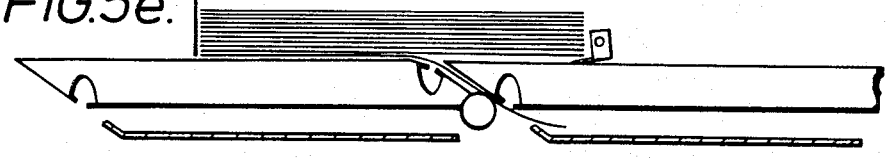
Figure 5F:
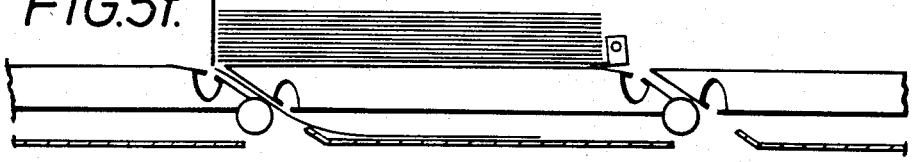
Figure 6A:
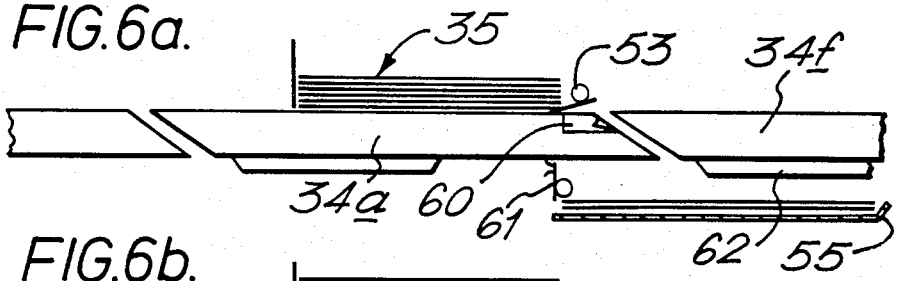
Figure 6B:
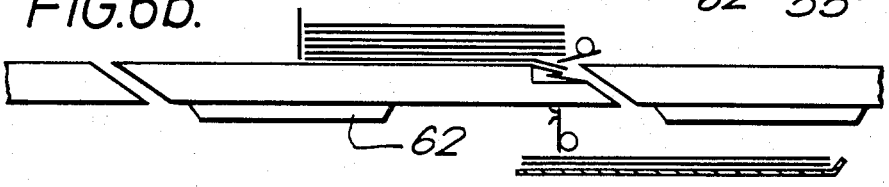
Figure 6C:
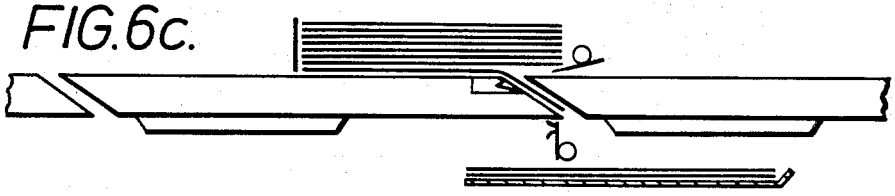
Figure 6D:
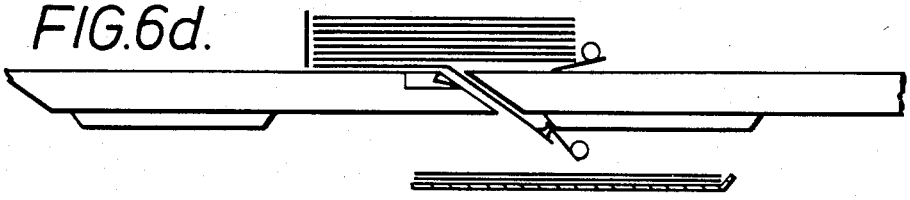
Figure 6E:
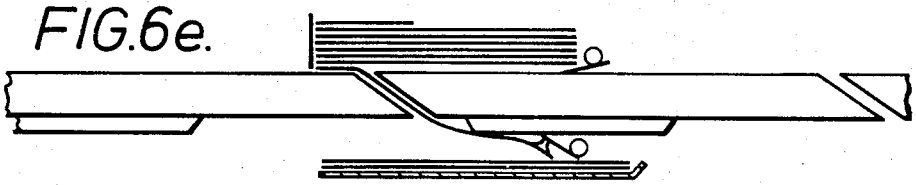
Figure 6F:
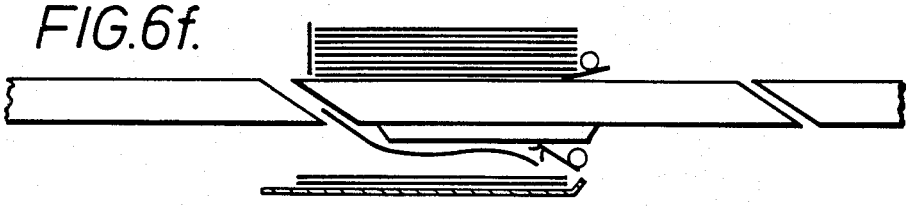

As will be seen from FIGS. 1 and 2, the rigid top plate 30 is provided with a plurality of radially outwardly projecting clamps 31 which comprise radially outwardly extending arms 32. These clamps 31 are detachably connected to the top plate 30 and can be adjusted about the central vertical axis of the machine to the angle needed. The underside of each clamp 31 is provided with a downwardly projecting finger 33 at a radial distance from the central axis of the machine which positions the finger just radially inwardly of the edge of the upper support plate 27.

The actual table, which constitutes the heart of the present invention, comprises a plurality of sections which together make up the circular table shown in FIG. 1. In the illustrated embodiment the table is made up of six sections indicated generally at 34*a* to 34*f*. It should be understood however that the invention is not limited to the use of six table sections, as a greater or lesser number could alternatively be used, even a table having just one slot. Stacks 35 of the material, e.g. paper, card, folded sections or the like, are arranged on the top of the wedge-shaped table sections. As shown in FIG. 1, the stacks 35 of sheets are associated one with each clamp arm 32, the clamp arm serving as a side lay for the stack and accurately defining its position on the table. Again as will be seen from FIG. 1, the stacks of sheets are arranged upon the table segments so that each stack has one corner projecting as a leading corner. The stacks of sheets are held stationary by the clamp arms, and the table 34*a* to 34*f* rotates beneath the stacks in the clockwise direction as viewed in FIG. 1, and as indicated by the arrow 36.

It will be appreciated from the drawings that between each of the wedge-shaped table sections 34*a* to 34*f* there is a slot which extends from the perimeter of the table in to the perimeter of the upper and lower support plates 27 and 26. With a six-segment table as shown in the illustrated embodiment there are therefore six such separator slots. The number of stacks 35 is determined only by the size of the sheets required to be collated. The stacks are arranged around the table regardless of the segments on a radius that puts the leading corner of each stack over a suction port 48. Each stack is separated and held in position by one of the clamps 32, making the space between the leading corner of one stack and the back edge of the next stack as little as 20 mm. Therefore up to 16 stacks of A5 size material can be collated at one time, or 7 stacks of A3 size material. In the arrangement illustrated in FIG. 1, each table segment carries two stacks 35 of sheets, with two clamp assemblies 32 being associated with each table segment. In the case of larger sheets of material, every alternate clamp assembly 32 could be detached and the remaining clamp assemblies reset so that each table segment would then support just one stack of sheets. In every case however it is important that the stacks 35 are set and aligned so that the leading corner of each stack lies on a common circle, such as the circle 37 which is indicated by a chain-dotted line in FIG. 1.

Viewed in cross-section, as in FIG. 2, each of the wedge-shaped table segments 34*a* to 34*f* comprises a horizontal upper table plate 38 and a lower portion 39, connected by a circumferential web 40. The lower portion 39, as indicated in the scrap view in FIG. 2, is ribbed or castellated both to give it strength and also to define ducts and passageways which can be used to control the air flow within the table. The upper table plate 38 of each of the table segments is provided with perforations 41 in order to enable air under pressure to be forced through the holes 41 in an upward direction. These holes 41 are provided with ball check valves, as shown in the scrap view in FIG. 2. With no stack on the table the captive ball 41*a* is forced up into the hole 41 by the air pressure from below so as to project slightly above the surface 41*b* and to close the valve. When one or more sheets are laid on the table surface 41*b* the ball 41*a* is depressed just enough to open the valve and allow air to flow past the ball. These air holes 41 are provided over substantially the whole of the table so that the rotatable table constitutes an air-bed and the stacks of paper laid upon the table will be subjected to this upward pressure of air to reduce the friction between the stationary stacks of sheets and the rotating table. One can therefore regard a stack of sheets placed upon the table as being "fluidized" by this air pressure from the holes 41. The way in which the surface of the table is perforated and valved to provide the air pressure is a very simple and yet effective system. As the air pressure builds up in the table the venturi effect of the escaping air between the seat in the underside of the upper table plate 38 and the ball 41*a* which is retained in close proximity to the seat lifts the ball, thereby closing the valve and allowing the air pressure to build further, until sufficient weight is applied to the slightly protruding ball to release the air pressure under the paper stack. By this means, as soon as the paper stack becomes too light to overcome the air pressure, the valve will close, thereby ensuring that when a few sheets of paper are left, it will still remain in control. This completely removes the need for springs and multi-part valve mechanisms which are expensive, difficult to install, exert a constant minimum spring force, and are subject to considerable wear.

As can be seen in the embodiment illustrated by FIGS. 3, 4 and 5, the radially extending separator slots in the table extend downwardly at an angle of about 35° to the horizontal. Each table segment 34*a* to 34*f* has an upper leading edge 42 which defines an acute-angled wedge, and an upper trailing edge, which is not a sharp edge but a smoothly curving convex zone, as is shown in FIG. 3. The curvature begins quite gradually and then becomes more acute. This is to facilitate separation or "breakaway" of the lowermost sheet from the stack and onward guidance of the separated sheet down into the slot. The bottom of each table segment comprises an obtuse-angled leading edge and an acute-angled trailing edge where a number of sheet-delivery wheels 43 are positioned. As shown in FIG. 2 these delivery wheels 43 are driven by respective friction rollers 44 mounted on a rotatable shaft 45 which takes its drive, through suitable gearing, from the motor 24. The delivery wheels 43 are perforated and connected to suction to generate a sucking action. The purpose of these delivery wheels 43 will be described below.

Within the contour of each table segment there are two main ducts. One of these, indicated at 46, is provided along the upper trailing edge zone of the table segment, and the other, indicated at 47, is provided along the lower leading edge of each table segment. As can be seen from FIG. 2, these ducts extend over the greater part of the radial dimension of the table from a position radially outwardly of the circle 37 (FIG. 1) towards the central column of the machine where they communicate via suitable ports in the upper support plate 27 with the suction chamber 29. The smoothly downwardly curving upper trailing surface zone of each table segment which overlies the duct 46 is provided with a series of holes spaced along its length, only one such hole 48 being shown for each duct in FIGS. 1 and 2. The control circuitry is preferably set so that only the particular hole 48 in each duct which is aligned with the leading corner of the sheets is activated, the others being shut off. Thus, regardless of paper sheet size, there is always a suction hole 48 aligned with the leading corner. The lower leading edge of each table segment which overlies the duct 47 is similarly provided with a series of holes, one of which is indicated at 49 in FIG. 4*a*, and which are selectively actuated. The holes 48 are positioned in the downwardly curving surface so that the paper sheet corner meets the hole as the sheet separates from the stack. Each hole 48 preferably has a relatively small diameter body opening out to a larger diameter mouth. Positioned within each duct 46, 47 is a changeover valve, indicated generally at 50 in FIG. 2. Each changeover valve 50 controls the flow of air within the associated duct 46, 47. Each changeover valve includes a valve element 51 projecting upwardly above the surface of the upper support plate 27. These valve elements 51 are arranged to strike and be depressed by a cam 52 carried by the downwardly projecting finger 33 of each clamp mechanism 31. Thus, as the table rotates, the valve elements 51 are actuated by striking against the cams 52 and are depressed to actuate the changeover valves and effect control of the movement of air through the ducts 46 and 47. As can be seen from FIG. 2, in the region of changeover valve 50, the duct 46 can communicate by way of a port in the duct wall with the main chamber within the table segment. When the valve 50 is not actuated air can pass under pressure through this port into the duct 46 and is directed towards the hole 48 to provide a blowing effect at the hole. When the valve 50 is triggered, the port in the wall of the duct 46 is closed and a direct path is opened from the hole 48 back to the suction chamber 29. Alternatively, the differential pressure effect can be achieved just by switching from suction, i.e. negative pressure, to normal pressure. The position of the clamp mechanisms 31 on the fixed top plate 30 is adjustable so that the clamp mechanisms and the cams 52 which operate the changeover valves 50 can be set to the correct angular positions to cause the valves to be triggered at the correct moments in the cycle.

Associated with each stack 35 of sheets is a separator blade which is indicated at 53 in FIGS. 4 and 5. This separator blade 53 is part of the sheet stack clamp mechanism and comprises a blade which lies beneath the leading corner of the stack of sheets. The separator blade 53 is freely pivotable about a horizontally extending shaft, and its angular position about this shaft is determined by the table surface along which it rides.

The method of operation of this embodiment of the collating/inserting machine will now be described with particular reference to FIGS. 4 and 5. It will be clearly apparent from the layout of FIG. 1 that the peeling away of the bottom sheet of each stack 35 is initiated at the leading corner which projects towards the oncoming table slots. By suitably controlling the times when there is suction and, if desired, pressure at the hole 48 which communicates with the duct 46, the leading corner of the bottommost sheet is sucked down, and thereafter the sheet is guided down through the slot between the table sections. Suction is applied at the hole 48 for only a relatively short period of time, i.e. just long enough for the corner of the sheet to be sucked down and started on its path down through the slot. The suction is then released and, preferably, air is blown out through the hole 48 to assist the onward movement of the sheet which is being peeled away. As mentioned above, it should be understood that the invention also covers the possibility of changing from suction to neutral pressure rather than from suction to positive pressure. In FIG. 4 there is shown the separation and onward feeding of folded sections of paper. These sections are folded so that the bottom fold extends out slightly beyond the upper fold. In FIG. 4*a* the upper trailing edge zone of table segment 34*a* is shown approaching the separator blade 53 which is restraining the corner of the stack of folded sections. In this embodiment, there is associated with each slot in the table a bar 54 which moves round with the table and which is positioned beneath and behind each respective slot so that the downwardly moving folded sections will drop over the bar 54 to form a collated set of sheets inserted one within another on the bar. In FIG. 4*b* the table has advanced to a position where the separator blade 53 tilts down as its blade begins to follow the downwardly sloping trailing edge of the table segment. Simultaneously with this, suction is applied by actuation of the changeover valve 50 to cause suction at the hole 48 and to cause the corner of the bottom fold to be sucked off the separator blade as the table passes beneath it. As the separator blade 53 is struck by the upper leading edge 42 of the next table segment 34*f* so it is tilted back again into its normal attitude where it catches beneath the extended bottom fold of the next folded section. Meanwhile, the first folded section is beginning its downward path into the separator slot. Because of the overlap on the lower fold of each folded section, the upper fold follows down into the separator slot because it is not caught up by the separator blade 53. Once the peeling action has been initiated by the sucking down of the corner of the bottommost fold, the onward movement of the table forces the folded section further down into the separator slot and this is assisted by changing over from a negative pressure to a positive pressure at the hole 48 in the duct 46. In FIG. 4*d* the folded section has advanced to a position where it is being guided onwards by the rotating delivery wheel 43 and where the top fold of the folded section is pulled upwards and is opened from the corner by suction applied through hole 49 in the duct 47. This causes the folded section to be opened sufficiently for it to be received on the bar 54, as shown in FIGS. 4*e* and 4*f*. Although not shown in the drawing, the suction of the delivery wheels 43 can be enhanced and aided by the use of sucker arms which are pivoted upwards to attract the bottom fold and aid the opening of the section.

The same separating action used to open up folded sections can also be used to separate and eject a double feed, i.e. two sheets fed through together, in single sheet feeding, thereby automatically eliminating the error without stopping or slowing the machine or requiring the operator's attention.

FIG. 5 shows a very similar arrangement, but here for the separation and feeding of single sheets. In this embodiment, instead of having a number of collecting bars 54 beneath the table, there are provided a plurality of collecting trays 55. As is shown in FIG. 2, these collecting trays 55 are connected to the annular lower support plate 26 and preferably slope outwardly and downwardly away from the center of the machine. A stripper brush 56 secured to the frame 12 of the machine co-operates with the collecting trays 55 to strip the collated sets of sheets from the trays 55 and drop them into a receiving tray 57. In FIG. 5, as in FIG. 4, if by chance two sheets are peeled away together, then the upward suction exerted through hole 49 in duct 47 at the bottom leading edge of the oncoming table segment will act on only one of the sheets and the bottommost sheet will be guided down and away by the delivery wheel 43 to direct this extra sheet to a discard tray (not shown).

FIGS. 6(*a*) to 6(*f*) show a modified form of table structure. This alternative embodiment removes the need for the ducts 47 at the lower leading edge of each table segment 34*a* to 34*f*, and also removes the need for the sheet delivery wheels 43 and their associated drive rollers 44. The embodiment of table structure shown in FIG. 6 is particularly suitable for use with relatively thick sheet materials, particularly thick card. As in FIGS. 4 and 5, there is provided a separator blade 53 which lies beneath the leading corner of the stack of sheets. In this embodiment, instead of providing a perforated duct 46 extending along the greater part of the length of the upper trailing edge of each table segment, this portion of each table segment 34*a* to 34*f* is formed as a collapsible bellows, indicated generally in FIG. 6 at 60. This bellows portion 60 of each table segment is controlled as to its state of inflation or deflation by the changeover valve 50. One can either arrange for the whole active length of the slot to be collapsible along the edge, or else have separate bellows sections which are individually controllable. FIG. 6(*a*) shows the position where the bellows 60 is fully inflated by air pressure from the center of the table. As the relative rotation of the table and the stacks of sheets causes the position shown in FIG. 6(*b*) to be reached, the valve mechanism 50 is actuated, causing suction to be applied to the bellows, collapsing the bellows and thereby exerting a positive diverting effect on the leading corner of the bottom sheet such that it is directed down into the slot between the table segments. In FIG. 6(*c*), where the bottom sheet has now passed into the slot, the bellows 60 is inflated again to restore the original contour of the table segment and to ensure continued guidance of the bottom sheet down into the slot. With this collapsible bellows arrangement, although it is still desirable to initiate the peeling of the bottom sheet from the stack at a corner of the sheet, one could alternatively initiate peeling along an edge of the sheet. This would entail a rearrangement of the position of the stacks on the top of the table. In any event, the peeling action is initiated by the cyclic timed application of suction, i.e. a negative pressure, to the appropriate part of the individual table segments.

FIG. 6 also shows an alternative structure beneath the table for positive guidance of the sheets as they emerge from the bottom of the slots in the table. Receiving trays 55 are positioned beneath the table, as in FIG. 5, and are movable with the table. Associated with each stack 35 of sheets, at a fixed position beneath the table, is a pivotable valved suction element or sucker 61. This sucker 61 is connected to the controlled air supply so that it is switched on and off in a cyclic timed sequence to match the other movements of the machine within the normal operating cycle. As is shown in FIGS. 6(*a*) to 6(*c*), the sucker 61 is normally positioned in an upright attitude beneath the table. As the table rotates so that one of the slots passes over the sucker 61 the sucker is connected to a source of suction and is actuated so that as a sheet emerges from the bottom of the slot the sucker 61 picks up the sheet, as shown in FIG. 6(*d*). The sucker 61 is also pivoted forward by being struck by a cam 62 provided on the underside of the table. The sucker 61 is controlled to maintain hold of the sheet until the major part of the sheet has emerged from the slot in the table, whereupon the suction is cut off and the sucker 61 releases the sheet into the collecting tray 55, as shown in FIG. 6(*f*). The use of this suction device beneath the table enables one to omit the rollers 43 and 44 and thus leaves more working space immediately in front of the bottom of each slot in the table. The use of the sucker 61 is also particularly useful when one is dealing with inserts where one wishes to hold the folded sheet open in a positive manner, as shown for example in FIG. 4.

Although not shown in FIGS. 4, 5 and 6 the upper leading edge 42 of each table segment may be provided additionally with a slicing blade just above the table surface and projecting forward from the leading edge to assist with the sheet separation. This may be desirable in particular when dealing with relatively stiff sheets of material.

Also, it should be noted that the machine of the present invention can handle extremely large sheets of paper. If necessary, extension panels can be added circumferentially outside the illustrated table segments to enlarge the table area.

Finally, although in the description above reference has been made to a rotary machine in which the table rotates beneath stationary stacks of material, the invention does also include the opposite arrangement where the table is stationary and the stacks are moved over the table to effect the peeling action. In essence all that is required is that there should be relative movement between the table and the stacks.

We claim:

1. A method of collating and/or inserting into one another individual sheets from a plurality of stacks of sheets of material arranged spaced around the center of a circle on a table, in which the table is provided with at least one substantially radial slot down through which the sheets are arranged to pass as they are separated from the bottom of the respective stacks, said table including at least one table section having an at least semi-rigid terminal wall portion adjoining said at least one slot, comprising effecting relative rotational movement between the table and the stacks, initiating separation of the bottom sheet of a stack at least partially by generating a suction effect in a cyclically controlled manner within said terminal wall portion of said table section at the upper trailing edge region of said terminal wall portion and aiding onward movement of the bottom sheet down into and through said slot by terminating the suction effect after the bottom sheet has been diverted into the slot.

2. A method as claimed in claim 1, in which onward movement and removal of the sheets from the slot is aided by cyclically controlling suction means located in a zone including the lower region of the slot and the region adjacent to the slot.

3. A method as claimed in claim 1 or 2, in which the change the suction effect created to initiate separation of the bottom sheet from the stack effects a change in the contour of the table surface over which the sheet passes immediately in advance of the slot.

4. A method as claimed in claim 1 or 2, which includes ducting air through the table under the control of valve means to generate both the changes in the suction effect and also to generate an upward pressure of air beneath each stack of sheets on the table.

5. A method as claimed in claim 1, in which the changes in the suction effect are selectively applicable at positions spaced along a substantial length of the slot.

6. A method as claimed in claim 1, which includes stacking the sheets on the table so that each sheet has a leading corner at which separation is initiated, the corners lying on a common circle, and controlling the changes in the suction effect by valve means responsive to the positions of the stacks on the table.

7. A method as claimed in claim 1, which includes applying suction to the sheets when the leading edge of the sheets are located in a zone including the bottom region of the slot and the region adjacent to the slot to hold the sheets positively until they are aligned with receiving means.

8. A rotary machine comprising a table for receiving a plurality of stacks of sheets of material spaced at intervals around a circle centered on the axis of rotation of the machine, means providing for relative rotational movement between the table and the stacks, the table defining at least one substantially radial slot down through which sheets separated from the bottom of the respective stacks are arranged to pass, suction means provided within the contour of a table section to create changes in air pressure at the upper trailing edge region of the table section to exert a suction effect on the bottom sheet of each stack, control means for said suction means operative to cause cyclic variations in the suction effect generated by said suction means on the sheets during the period from initial separation of a bottom sheet from a stack to completion of the movement of the sheet down through a slot whereby the suction effect is terminated after initial separation of a bottom sheet from a stack and before completion of movement of the sheet down through the slot.

9. A machine as claimed in claim 8, in which the upper portion of the table immediately in front of the slot in the direction of advance is displaceable in response to actuation of said suction means to change the contour of the table surface over which the sheet passes.

10. A machine as claimed in claim 9, in which said upper portion of the table immediately in front of the slot comprises at least one bellows connected to said suction means.

11. A machine as claimed in claim 8, in which the upper portion of the table immediately in front of the slot in the direction of advance is provided with a plurality of holes along a substantial length of the slot, the holes being in communication with said suction means and selectively controlled by said control means.

12. A machine as claimed in claim 8, in which the slot in the table is inclined downwards and has generally parallel rectilinear faces so as to define a sharp top edge of the table rearwardly of the slot in the direction of advance and a smoothly downwardly extending top surface to the table forwardly of the slot in the direction of advance.

13. A machine as claimed in claim 12, in which the slot is inclined at an angle of the order of 55° to the vertical.

14. A rotary machine comprising a table for receiving a plurality of stacks of sheets of material spaced at intervals around a circle centered on the axis of rotation of the machine, the table being provided with at least one substantially radial slot down through which sheets separated from the bottom of the respective stacks are arranged to pass, suction means within the contour of the table to create changes in air pressure in a zone including the upper region of the slot and the region adjacent to the slot, control means for said suction means operative to cause cyclic variations in the effect generated by said suction means on the sheets during the period from initial separation of a bottom sheet from a stack to movement of said sheet down through a slot, and further suction means located in a zone including the lower region of the slot and the region adajacent to the slot.

15. A machine as claimed in claim 14, in which said further suction means comprises an attraction element mounted in fixed relationship to the table adjacent to the bottom of the slot below the level of the table.

16. A machine as claimed in claim 15, in which said further suction means comprises a plurality of suction holes provided along a substantial length of the slot in the lower portion of the table immediately behind the or each slot in the direction of advance.

17. A machine as claimed in claim 14, in which said control means control the function of said further suction means in a cyclic manner matched to the movement of the sheets through the slot.

18. A rotary machine comprising a table for receiving a plurality of stacks of sheets of material spaced at intervals around a circle centered on the axis of rotation of the machine, the table being provided with at least one substantially radial slot down through which sheets separated from the bottom of the respective stacks are arranged to pass, suction means within the contour of the table to create changes in air pressure located in a zone including the upper region of the slot and the region adjacent to the slot, control means for said suction means operative to cause cyclic variations in the effect generated by said suction means on the sheets during the period from initial separation of a bottom sheet from a stack to movement of said sheet down through a slot, and a separator blade associated with each stack of sheets and underlying a leading corner of the stack, the blade being pivotable and riding on the surface of the table so as to tilt downwards as said blade passes over the slot to aid separation of the leading corner of the bottommost sheet.

19. A rotary machine comprising a table for receiving a plurality of stacks of sheets of material spaced at intervals around a circle centered on the axis of rotation of the machine, the table being provided with at least one substantially radial slot down through which sheets separated from the bottom of the respective stacks are arranged to pass, suction means within the contour of the table to create changes in air pressure located in a zone including the upper region of the slot and the region adjacent to the slot, control means for said suction means operative to cause cyclic variations in effect generated by said suction means on the sheets during the period from initial separation of a bottom sheet from a stack to movement of said sheet down through a slot, and adjustable clamp means to locate each stack of sheets in place on the table, said clamp means comprising abutment means which, as relative rotation occurs between the table and the stacks, actuate valve means which control said suction means in synchronism with the rotary movement.

20. A rotary machine comprising a table for receiving a plurality of stacks of sheets of material spaced at intervals around a circle centered on the axis of rotation of the machine, the table being provided with at least one substantially radial slot down through which sheets separated from the bottom of the respective stacks are arranged to pass, suction means within the contour of the table to create changes in air pressure located in a zone including the upper region of the slot and the region adjacent to the slot, and control means for said suction means operative to cause cyclic variations in the effect generated by said suction means on the sheets during the period from initial separation of a bottom sheet from a stack to movement of said sheet down through a slot, the table comprising at least one perforated upper plate and at least one ribbed lower plate, the upstanding rib portion serving as support means for a ball check valve associated with the perforations, whereby air can pass up through the perforations when the check valve is opened by the weight of sheets thereon.

21. A method as claimed in claim 1, including aiding onward movement of the bottom sheet down into and through said slot by reversing the suction effect after the bottom sheet has been diverted into the slot.

22. A machine as claimed in claim 8 in which the control means for the suction means is operative to cause cyclic variations in the suction effect generated by said suction means on the sheets during the period from initial separation of a bottom sheet from a stack to completion of the movement of said sheet down through a slot whereby the suction effect is reversed after initial separation of a bottom sheet from a stack and before completion of movement of said sheet down through the slot.

* * * * *